US007997058B2

(12) United States Patent
Farhangi et al.

(10) Patent No.: US 7,997,058 B2
(45) Date of Patent: Aug. 16, 2011

(54) APPARATUS FOR MIXING SUBSTANCES

(75) Inventors: Shahram Farhangi, Woodland Hills, CA (US); David R. Matthews, Simi Valley, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 213 days.

(21) Appl. No.: 12/395,845

(22) Filed: Mar. 2, 2009

(65) Prior Publication Data

US 2009/0158742 A1 Jun. 25, 2009

Related U.S. Application Data

(60) Continuation of application No. 11/311,835, filed on Dec. 19, 2005, now Pat. No. 7,516,607, which is a division of application No. 10/682,943, filed on Oct. 10, 2003, now Pat. No. 7,017,329.

(51) Int. Cl.
*F02C 1/00* (2006.01)

(52) U.S. Cl. ..... 60/39.11; 60/723; 60/737

(58) Field of Classification Search ..... 60/39.11, 60/737, 738, 754, 723; 431/170, 354, 355
See application file for complete search history.

(56) References Cited

U.S. PATENT DOCUMENTS

| | | | | |
|---|---|---|---|---|
| 3,877,863 | A | 4/1975 | Penny | |
| 3,937,007 | A | 2/1976 | Kappler | |
| 4,045,159 | A * | 8/1977 | Nishi et al. | 431/328 |
| 4,113,425 | A | 9/1978 | von Linde et al. | |
| 4,474,140 | A | 10/1984 | Sternfeld | |
| 4,731,989 | A | 3/1988 | Furuya | |
| 4,870,824 | A | 10/1989 | Young | |
| 5,056,501 | A | 10/1991 | Ida | |
| 5,207,207 | A | 5/1993 | Pedersen | |
| 5,281,128 | A | 1/1994 | Dalla Betta | |
| 5,309,637 | A | 5/1994 | Moriarty | |
| 5,319,923 | A | 6/1994 | Leonard | |
| 5,461,864 | A | 10/1995 | Betta | |
| 5,511,972 | A | 4/1996 | Dalla Betta | |
| 5,512,250 | A | 4/1996 | Dalla Betta | |
| 5,518,697 | A | 5/1996 | Dalla Betta | |
| 5,577,906 | A | 11/1996 | Hanakata | |
| 5,709,077 | A | 1/1998 | Beichel | |
| 5,715,673 | A | 2/1998 | Beichel | |

(Continued)

FOREIGN PATENT DOCUMENTS

EP 0304707 3/1989

(Continued)

OTHER PUBLICATIONS

Catalytica, How it Works, http:/www.catalyticaenergy.com/xonon/how_it_works.html, printed Feb. 6, 2002. Catalytica, How it Works, http:/www.catalyticaenergy.com/xonon/how_it_works1.html, printed Feb. 6, 2002.

*Primary Examiner* — Louis Casaregola
(74) *Attorney, Agent, or Firm* — Carlson, Gaskey & Olds, P.C.

(57) ABSTRACT

A combustor assembly for a gas powered turbine includes a premix section to mix a first selected volume of fuel with a selected oxidizer. The premix section includes an injector plate that includes a porosity according to selected characteristics, such as pore size, pore density, pore distribution, and other selected characteristics. Therefore, the fuel may be provided through the porous plate to the premix area in a selected uniform flux.

9 Claims, 6 Drawing Sheets

U.S. PATENT DOCUMENTS

| | | | |
|---|---|---|---|
| 5,899,679 | A | 5/1999 | Euzen |
| 5,956,937 | A | 9/1999 | Beichel |
| 5,970,702 | A | 10/1999 | Beichel |
| 6,170,264 | B1 | 1/2001 | Viteri |
| 6,174,159 | B1 | 1/2001 | Smith |
| 6,192,688 | B1 | 2/2001 | Beebe |
| 6,202,402 | B1 | 3/2001 | Sattelmayer |
| 6,205,768 | B1 | 3/2001 | Dibble |
| 6,358,040 | B1 | 3/2002 | Pfefferle |
| 6,415,608 | B1 | 7/2002 | Newburry |
| 6,584,760 | B1 | 7/2003 | Lipinski |
| 6,709,264 | B2 | 3/2004 | Hermann |
| 7,007,486 | B2 * | 3/2006 | Sprouse et al. ..... 60/776 |
| 7,117,676 | B2 * | 10/2006 | Farhangi et al. ..... 60/736 |
| 2002/0139119 | A1 | 10/2002 | Touchton |
| 2003/0056519 | A1 | 3/2003 | Newberry |

FOREIGN PATENT DOCUMENTS

| | | |
|---|---|---|
| JP | 58179730 | 10/1983 |
| JP | 59107119 | 6/1984 |
| JP | 6064131 | 4/1985 |
| JP | 6066022 | 4/1985 |
| WO | 0227243 | 4/2002 |

* cited by examiner

APPARATUS FOR MIXING SUBSTANCES

CROSS-REFERENCE TO RELATED APPLICATIONS

This application is a continuation of U.S. patent application Ser. No. 11/311,835, filed Dec. 19, 2005 now U.S. Pat. No. 7,516,607, which is a divisional of U.S. patent application Ser. No. 10/682,943 filed on Oct. 10, 2003 now U.S. Pat. No. 7,017,329.

FIELD OF THE INVENTION

The present invention relates generally turbines for generating power, and more particularly to a gas powered turbine system.

BACKGROUND

It is generally known in the art to power turbines with gases being expelled from combustion chambers. These gas powered turbines can produce power for many applications such as terrestrial power plants. In the gas powered turbine a fuel, such as a hydrocarbon (for example methane or kerosene), hydrogen, or SYNTHESIS is combusted in an oxidizer, such as oxygen, rich environment. Generally, these combustion systems have high emissions of undesirable compounds such as nitrous oxide compounds (NOX) and carbon containing compounds. It is generally desirable to decrease these emissions as much as possible so that undesirable compounds do not enter the atmosphere. In particular, it has become desirable to reduce NOX emissions to a substantially low amount. Emissions of NOX are generally desired to be non-existent, and are accepted to be non-existent, if they are equal to or less than about one part per million volume of dry weight emissions.

In a combustion chamber fuel, such as methane or natural gas, is combusted in atmospheric air where temperatures generally exceed about 1427° C. (about 2600° F.). When temperatures are above 1427° C., the nitrogen and oxygen compounds, both present in atmospheric air, undergo chemical reactions which produce nitrous oxide compounds. The energy provided by the high temperatures allows the breakdown of dinitrogen and dioxygen, especially in the presence of other materials such as metals, to produce NOX compounds such as $NO_2$ and NO.

It has been attempted to reduce NOX compounds by initially heating the air before it enters the combustion chambers to an auto-ignition temperature. If the air enters the combustion chamber at an auto-ignition temperature, then no flame is necessary to combust the fuel. Auto-ignition temperatures are usually lower than pilot flame temperatures or the temperatures inside recirculation flame holding zones. If no flame is required in the combustion chamber, the combustion chamber temperature is lower, at least locally, and decreases NOX emissions. One such method is to entrain the fuel in the air before it reaches the combustion chamber. This vitiated air, that is air which includes the fuel, is then ignited in a preburner to raise the temperature of the air before it reaches the main combustion chamber. This decreases NOX emissions substantially. Nevertheless, NOX emissions still exist due to the initial pre-burning. Therefore, it is desirable to decrease or eliminate this pre-burning, thereby substantially eliminating all NOX emissions.

Although the air is heated before entering the main combustion chamber, it may still be ignited in the combustion chamber to combust the remaining fuel. Therefore, an additional flame or arc is used to combust remaining fuel in the main combustion chamber. This reduces the temperature of the igniter, but still increases the temperature of the combustion chamber. In addition, no fuel is added to the air as it enters the combustion chamber. Rather all the fuel has already been entrained in the air before it enters the combustion chamber to be combusted. This greatly reduces control over where combustion occurs and the temperature in the combustion chamber Other attempts to lower NOX emissions include placing catalysts in catalytic converters on the emission side of the turbines. This converts the NOX compounds into more desirable compounds such as dinitrogen and dioxygen. These emission side converters, however, are not one hundred percent efficient thereby still allowing NOX emissions to enter the atmosphere. The emission converters also use ammonia $NH_3$, gas to cause the reduction of NOX to $N_2$. Some of this ammonia is discharged into the atmosphere. Also, these converters are expensive and increase the complexity of the turbine and power production systems. Therefore, it is also desirable to eliminate the need for emission side catalytic converters.

SUMMARY

A gas powered turbine including at least a combustion chamber to combust a selected fuel and an oxidizer to produce a gas to power a turbine. Generally, the turbine includes a compressor which compresses a selected oxidizer to combust a fuel in a selected manner to produce an expanding gas to power a turbine fan. Fuels are generally combusted in the combustor using an appropriate method, such as increasing the temperature of an oxidizer to a temperature able to combust the fuel without the addition of a holding flame, a combustion flame, or other high temperature applications.

To produce a high energy or high temperature oxidizer stream, a portion of fuel is generally first combusted in an oxidizer to increase the temperature of the oxidizer stream to a selected temperature. The initial portion of fuel may be combusted in any appropriate manner such as in a heat exchanger combustor. Such heat exchanger combustors are disclosed in U.S. Patent Application Publication No. 2003/0192319, published Oct. 16, 2003 and entitled "CATALYTIC COMBUSTOR AND METHOD FOR SUBSTANTIALLY ELIMINATING NITROUS OXIDE EMISSIONS," incorporated herein by reference. These heat exchanger combustion systems allow for a selected portion of fuel to combust to raise a temperature of the oxidizer to a first selected temperature such that a second portion of fuel may then combust in the heated oxidizer stream to produce the expanding gases to power the turbine without producing undesired chemical species such as nitrous oxide compounds.

A premix injector may be used to inject a first selected amount of fuel into an oxidizer before a primary combustion chamber. The pre-mixer allows a selected portion of fuel to mix with the selected oxidizer such that the first portion of fuel may be combusted to achieve the selected high energy or selected temperature of the oxidizer. A pre-mixer injector may include a substantially porous plate that includes a plate of a selected porosity, pore size, size, and other appropriate physical attributes. The porous injector plate is able to inject a fuel according to selected properties, such as rate, volume, dispersion to achieve the selected pre-mixture and pre-burning.

According to various embodiments a power turbine including a combustor to combust a selected fuel in a selected oxidizer includes a premix chamber to allow mixing of the selected fuel and the selected oxidizer. The power turbine also includes an oxidizer supply to supply the selected oxidizer to the premix chamber and a fuel supply to supply the selected fuel to the premix chamber. Also, a porous injector plate injects the fuel into the premix chamber. The selected fuel is provided through the porous injector plate to mix with the selected oxidizer from the oxidizer supply.

According to various embodiments a system for allowing a substantially even flux of a fuel into a combustor for a power plant includes a mixing area operable to allow mixing of a selected volume of fuel and a selected volume of an oxidizer. A plurality of pores are defined by an injection plate such that a selected flux of fuel is substantially provided to the mixing area. A fuel supply supplies the selected volume of fuel to an upstream side of the injection plate. A selected pressure on the upstream side urges the fuel through the plurality of pores into the mixing area.

According to various embodiments a method of combusting a fuel for a gas powered turbine in the presence of atmospheric air includes injecting a selected first volume of fuel into a mixing area with a substantially even flux. The first volume of a fuel is substantially mixed with an oxidizer. An auto-ignition oxidizer stream is produces and a second volume of the fuel homogeneously combusts spontaneously upon reaching the temperature of the auto-ignition oxidizer stream. The second volume of the fuel is provided to the auto-ignition oxidizer stream. The second volume of the fuel combusts to form expanding gases in the absence of a flame source.

Further areas of applicability of the present invention will become apparent from the detailed description provided hereinafter. It should be understood that the detailed description while indicating the various embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF VARIOUS EMBODIMENTS

The following description of various embodiments is merely exemplary in nature and is in no way intended to limit the invention, its application, or uses. Specifically, although the following combustor is described in conjunction with a terrestrial gas turbine, it may be used in other systems. Furthermore, the mixer and heat exchanger may be used in systems other than turbine systems.

Figure 1:
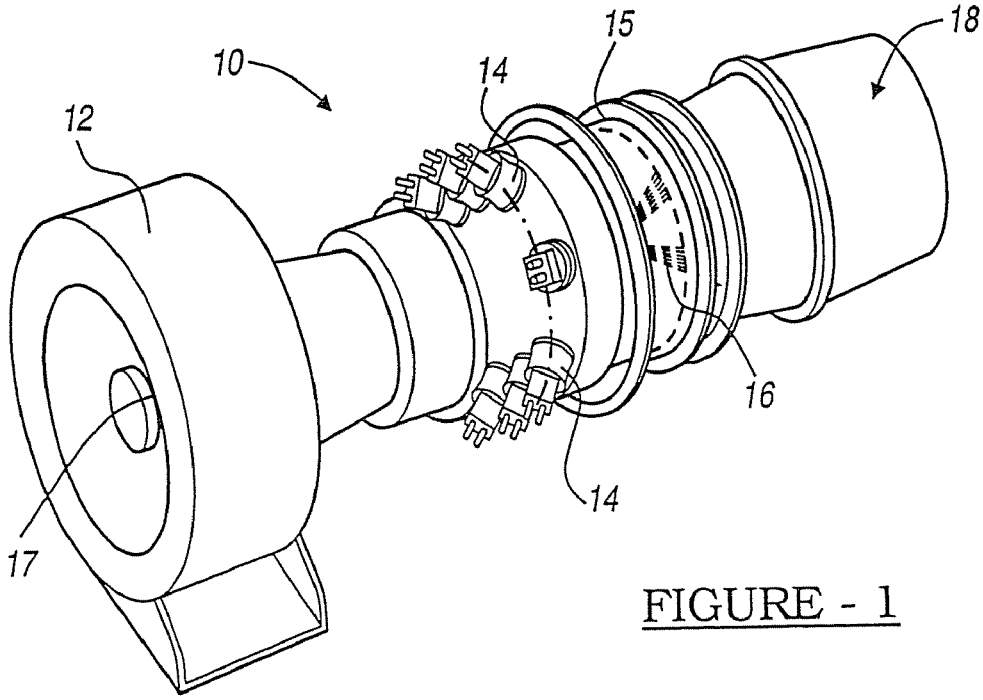
FIG. 1 is a perspective view of a gas powered turbine including a combustor in accordance with the present invention.

Referring to FIG. 1, a gas powered turbine in accordance with a preferred embodiment of the present invention is shown. The gas powered combustion turbine 10 may use several different gaseous fuels, such as hydrocarbons (including methane and propane) and hydrogen, that are combusted and that expand to move portions of the gas powered turbine 10 to produce power. An important component of the gas powered turbine 10 is a compressor 12 which forces atmospheric air into the gas powered turbine 10. Also, the gas powered turbine 10 includes several combustion chambers 14 for combusting fuel. The combusted fuel is used to drive a turbine 15 including turbine blades or fans 16 which are axially displaced in the turbine 15. There are generally a plurality of turbine fans 16, however, the actual number depends upon the power the gas powered turbine 10 is to produce. Only a single turbine fan is illustrated for clarity.

In general, the gas powered turbine 10 ingests atmospheric air, combusts a fuel in it, which powers the turbine fans 16. Essentially, air is pulled in and compressed with the compressor 12, which generally includes a plurality of concentric fans which grow progressively smaller along the axial length of the compressor 12. The fans in the compressor 12 are all powered by a single axle. The high pressure air then enters the combustion chambers 14 where fuel is added and combusted. Once the fuel is combusted, it expands out of the combustion chamber 14 and engages the turbine fans 16 which, due to aerodynamic and hydrodynamic forces, spins the turbine fans 16. The gases form an annulus that spin the turbine fans 16, which are affixed to a shaft (not shown). Generally, there are at least two turbine fans 16. One or more of the turbine fans 16 engage the same shaft that the compressor 12 engages.

The gas powered turbine 10 is self-powered since the spinning of the turbine fans 16 also powers the compressor 12 to compress air for introduction into the combustion chambers 14. Other turbine fans 16 are affixed to a second shaft 17 which extends from the gas powered turbine 10 to power an external device. After the gases have expanded through the turbine fans 16, they are expelled out through an exhaust port 18. It will be understood that the gas powered turbines are used for many different applications such as engines for vehicles and aircraft or for power production in a terrestrially based gas powered turbine 10.

The gases which are exhausted from the gas powered turbine 10 include many different chemical compounds that are created during the combustion of the atmospheric air in the combustion chambers 14. If only pure oxygen and pure hydrocarbon fuel, were combusted, absolutely completely and stoichiometrically, then the exhaust gases would include only carbon dioxide and water. Atmospheric air, however, is not 100% pure oxygen and includes many other compounds such as nitrogen and other trace compounds. Therefore, in the high energy environment of the combustion chambers 14, many different compounds may be produced. All of these compounds exit the exhaust port 18.

It is generally known in the art that an equivalence ratio is determined by dividing the actual ratio of fuel and air by a stoichiometric ratio of fuel to air (where there is not an excess of one starting material). Therefore, a completely efficient combustion of pure fuel and oxygen air would equal an equivalence ratio of one. It will be understood that although atmospheric air in a hydrocarbon fuel may be preferred for economic reasons other oxidizers and fuels may be provided. The air simply provides an oxidizer for the fuel.

It will be understood that the gas powered turbine 10 may include more than one combustion chamber 14. Any reference to only one combustion chamber 14, herein, is for clarity of the following discussion alone. The present invention may be used with any oxidizer or fuel which is used to power the gas powered turbine 10. Moreover, the combustor 14 may combine any appropriate fuel. Air is simply an exemplary oxidizer and hydrocarbons an exemplary fuel.

Figure 2:
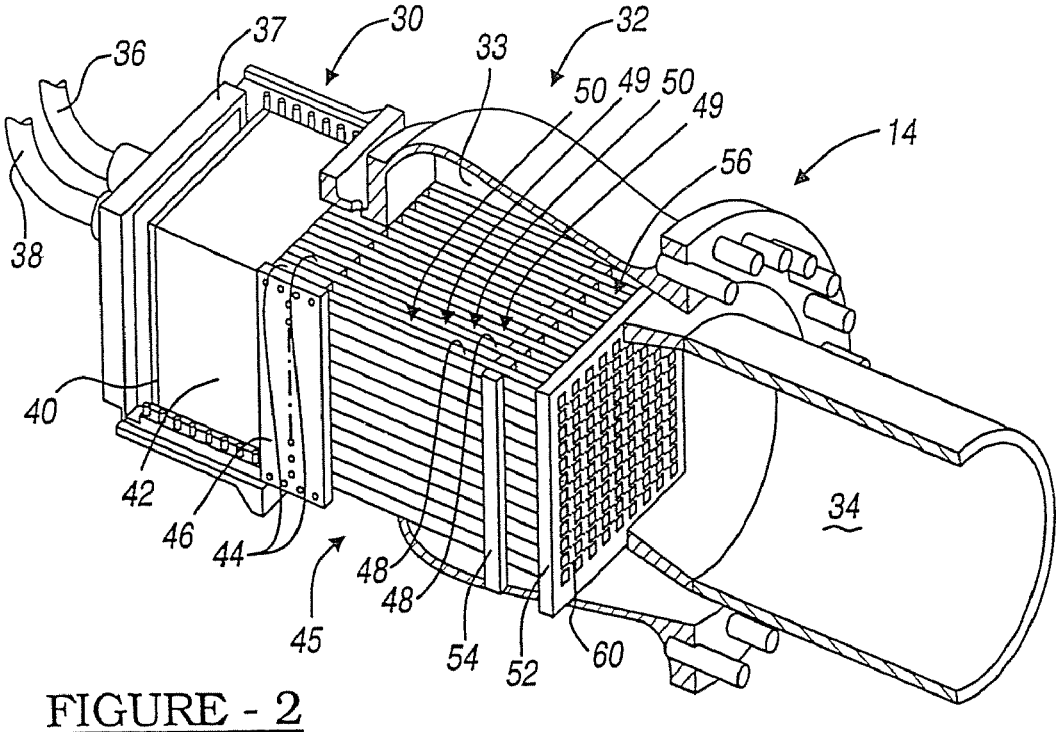
FIG. 2 is a partial cross-sectional perspective view of a single combustor.

With reference to FIG. 2, an exemplary combustion chamber 14 is illustrated. The combustion chamber may comprise any appropriate combustion chamber such as the one described in U.S. Patent Application Publication No. 2003/0192318, published Oct. 16, 2003 entitled, "Catalytic Combustor For Substantially Eliminating Nitrous Oxide Emissions," incorporated herein by reference. The combustion chamber 14 includes a premix section or area 30, a heat exchange or pre-heat section 32, generally enclosed in a heat exchange chamber 33, and a main combustion section 34. A first or premix fuel line 36 provides fuel to the premix area 30 through a fuel manifold 37 while a second or main fuel line 38 provides fuel to the main combustion section 34 through a main injector 52. Positioned in the premix area 30 is a premix injector 40 which injects fuel from the first fuel line 36 into a premix chamber or premixer 42. Air from the compressor 12 enters the premix area 30 through a plurality of cooling tubes 44 of a heat exchanger or pre-heater 45 (detailed in FIG. 3). The premix chamber 42 encompasses a volume between the premix injector 40 and the exit of the cooling tubes 44.

With further reference to FIG. 2, a plurality of catalytic heat exchange or catalyst tubes 48 extend into the heat exchange area 32. The heat exchange tubes 48 are spaced laterally apart. The heat exchange tubes 48, however, are not spaced vertically apart. This configuration creates a plurality of columns 49 formed by the heat exchange tubes 48. Each heat exchange tube 48, and the column 49 as a whole, define a pathway for air to travel through. The columns 49 define a plurality of channels 50. It will be understood this is simply exemplary and the tubes may be spaced in any configuration to form the various pathways. Extending inwardly from the walls of the heat exchange chamber 33 may be directing fins (not particularly shown). The directing fins direct the flow of air to the top and the bottom of the heat exchange chamber 33 so that air is directed to flow vertically through the channels 50 defined by the heat exchange tubes 48.

Near the ends of the heat exchange tubes 48, where the heat exchange tubes 48 meet the main combustion section 34, is a main injector 52. The second fuel line 38 provides fuel to the main injector 52 so that fuel may be injected at the end of each heat exchange tube 48. Spaced away from the main injector 52, towards the premix area 30, is an intra-propellant plate 54. The intra-propellant plate 54 separates the air that is traveling through the channels 50 and the fuel that is being fed to the fuel manifold region 56 between the main injector face 52 and intra-propellant plate 54. It will be understood, that the intra-propellant plate 54 is effectively a solid plate, though not literally so in this embodiment. The placement of the heat exchange tubes 48 dictate that the intra-propellant plate 54 be segmented wherein one portion of the intrapropellant plate 54 is placed in each channel 50 between two columns 49.

Air which exits out the heat exchange tubes 48 is entrained with fuel injected from an injector port 60 (illustrated more clearly herein) in the main injector 52 and this fuel then combusts in the main combustion section 34. The main combustion section 34 directs the expanding gases of the combusted fuel to engage the turbine fans 16 so that the expanded gases may power the turbine fans 16.

Figure 3:
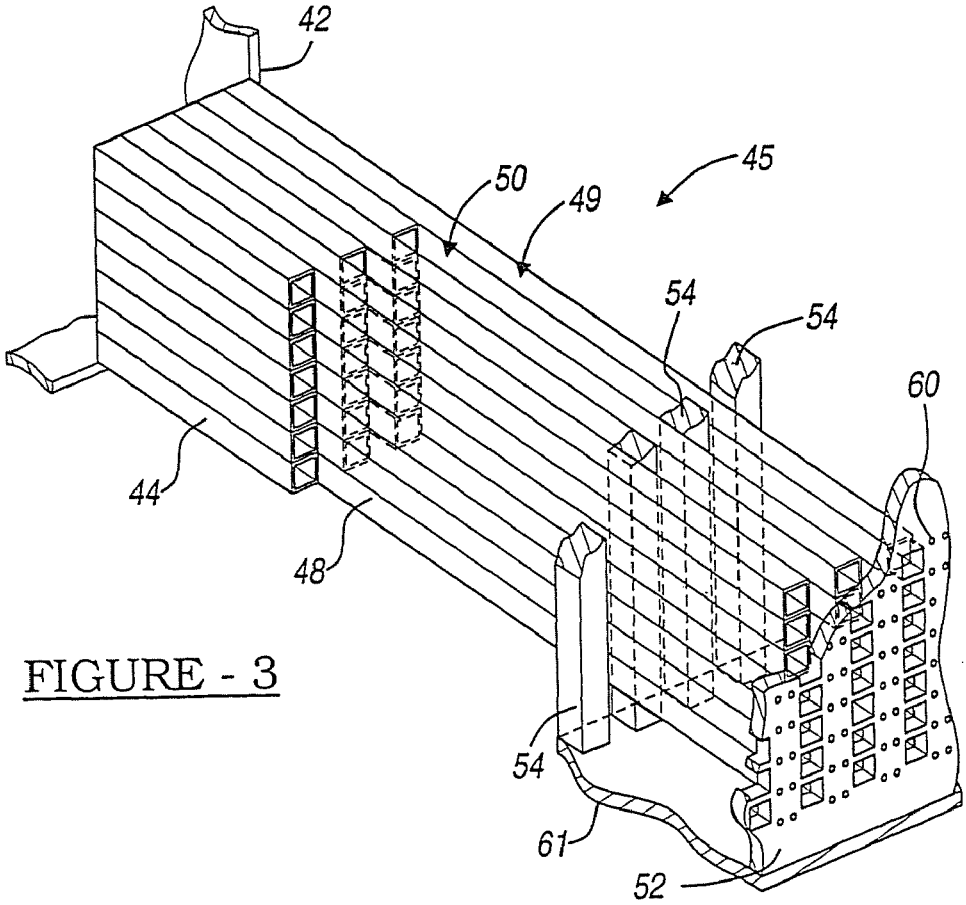
FIG. 3 is a detailed, partial cross-sectional, perspective view of a portion of the heat exchanger.

Turning reference to FIG. 3, a detailed portion of the heat exchanger 45 is illustrated. Although, in one embodiment, the heat exchanger 45 includes a large plurality of tubes, as generally shown in FIG. 2, only a few of the heat exchange tubes 48 and cooling tubes 44 are illustrated here for greater clarity. The heat exchanger 45 is similar to that described in U.S. Pat. No. 5,309,637 entitled "Method of Manufacturing A Micro-Passage Plate Fin Heat Exchanger", incorporated herein by reference. The heat exchanger 45 includes a plurality of cooling tubes 44 disposed parallel to and closely adjacent the heat exchange tubes 48. Each of the cooling tubes 44 and the heat exchange tubes 48 have a generally rectangular cross section and can be made of any generally good thermally conductive material. Preferably, the heat exchange tubes 48 and the cooling tubes 44 are formed of stainless steel. It will be appreciated that while the cooling tubes 44 and the heat exchange tubes 48 are shown as being substantially square, the cross-sectional shape of the components could comprise a variety of shapes other than squares. It is believed, however, that the generally square shape will provide the best thermal transfer between the tubes 44 and 48.

Both the cooling tubes 44 and the heat exchange tubes 48 may be of any appropriate size, but preferably each are generally square having a width and height of between about 0.04 inches and about 1.0 inches (between about 0.1 centimeters and about 2.5 centimeters). The thickness of the walls of the cooling tubes 44 and the heat exchange tubes 48 may be any appropriate thickness. The walls need to be strong enough to allow the fluids to flow through them, but still allow for an efficient transfer of heat between the inside of the heat exchange tubes 48 and the air in the channels 50 and cooling tubes 44. The thickness may also vary by size and material choice.

The cooling tubes 44 extend parallel to the heat exchange tubes 48 for a portion of the length of the heat exchange tubes 48. Generally, each of the cooling tubes 44 is brazed to one of the heat exchange tubes 48 for the distance that they are placed adjacent one another. Moreover, the cooling tubes 44 and the heat exchange tubes 48 may be brazed to one another. The cooling tubes 44 extend between the columns 49 of the heat exchanger tubes 48. According to various embodiments, brazing materials are those with melting temperatures above about 538° C. (about 1000° F.). The cooling tubes 44 extend between the columns 49 of the heat exchanger tubes 48. The cooling tubes 44 and the heat exchange tubes 48, when brazed together, form the heat exchanger 45 which can provide a surface-to-surface exchange of heat. It will be understood, however, that air traveling in the channels 50 between the heat exchange tubes 48 will also become heated due to the heat transferred from the heat exchange tubes 48 to the air in the channels 50.

Referring further to FIG. 3, fuel injector ports 60 are formed in the main injector 52. The injector ports 60 may be provided in any appropriate number. According to various embodiments, there is a ratio of heat exchange tubes 48 to injectors 60 of at least one. It will be understood, however, that any appropriate ratio of the injectors 60 to the heat exchange tubes 48 may be provided. The fuel is provided to the manifold region 56 which is bound by the intra-propellant plate 54, the main injector plate 52, and a manifold plate 61. The manifold plate 61 may underlay, overlay, or surround the manifold region 56. This provides fuel to each of the injector ports 60 without requiring an individual fuel line to each injector port 60. Therefore, as air exits each heat exchange tube 48, fuel is injected from the injector port 60 to the stream of air emitted from each heat exchange tube 48. In this way, the fuel can be very efficiently and quickly distributed throughout the air flowing from the heat exchanger 45, as discussed further herein.

On the interior walls of each heat exchange tube 48 is disposed a coating of a catalyst. The catalyst may be any appropriate catalyst that is able to combust a fuel such as hydrocarbon, hydrogen, and the like, and may include, for example, platinum, palladium, or mixtures thereof. The catalyst is able to combust a hydrocarbon fuel, such as methane, without the presence of a flame or any other ignition source. The catalyst is also able to combust the fuel without generally involving any side reactions. Therefore, the combustion of fuel does not produce undesired products. It will be understood that if the fuel is not a hydrocarbon then a different, appropriate catalyst is used. The catalyst allows combustion of the fuel without an additional heat source.

Figure 4:
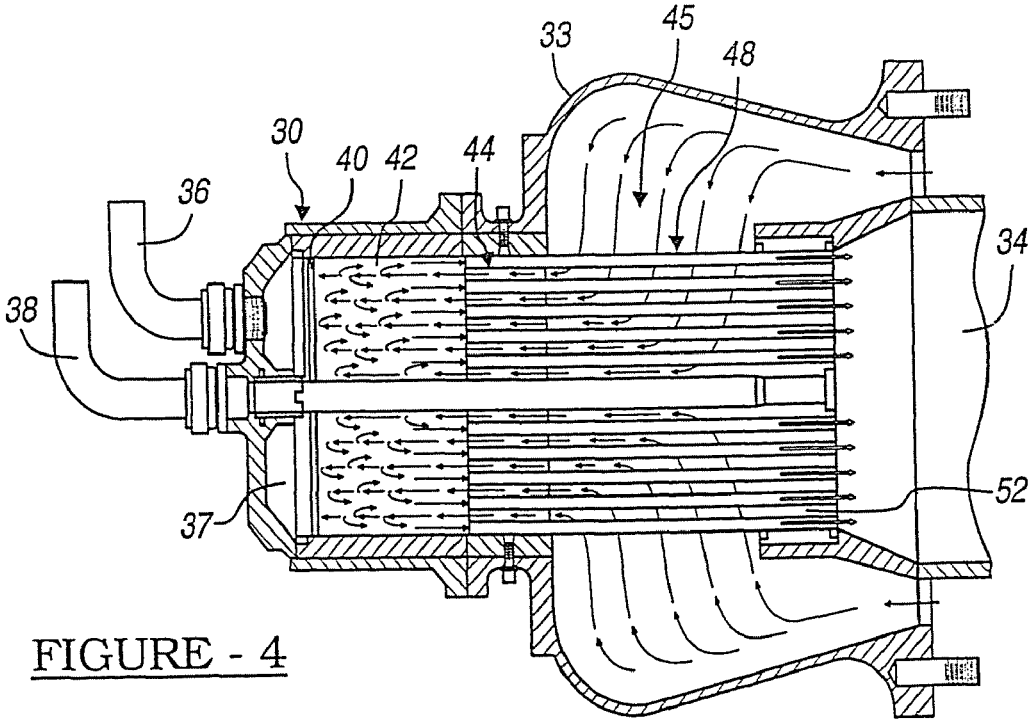
FIG. 4 is a simplified diagrammatic view of the flow of air through the combustion chamber according to a first embodiment of the present invention.
Figure 5:
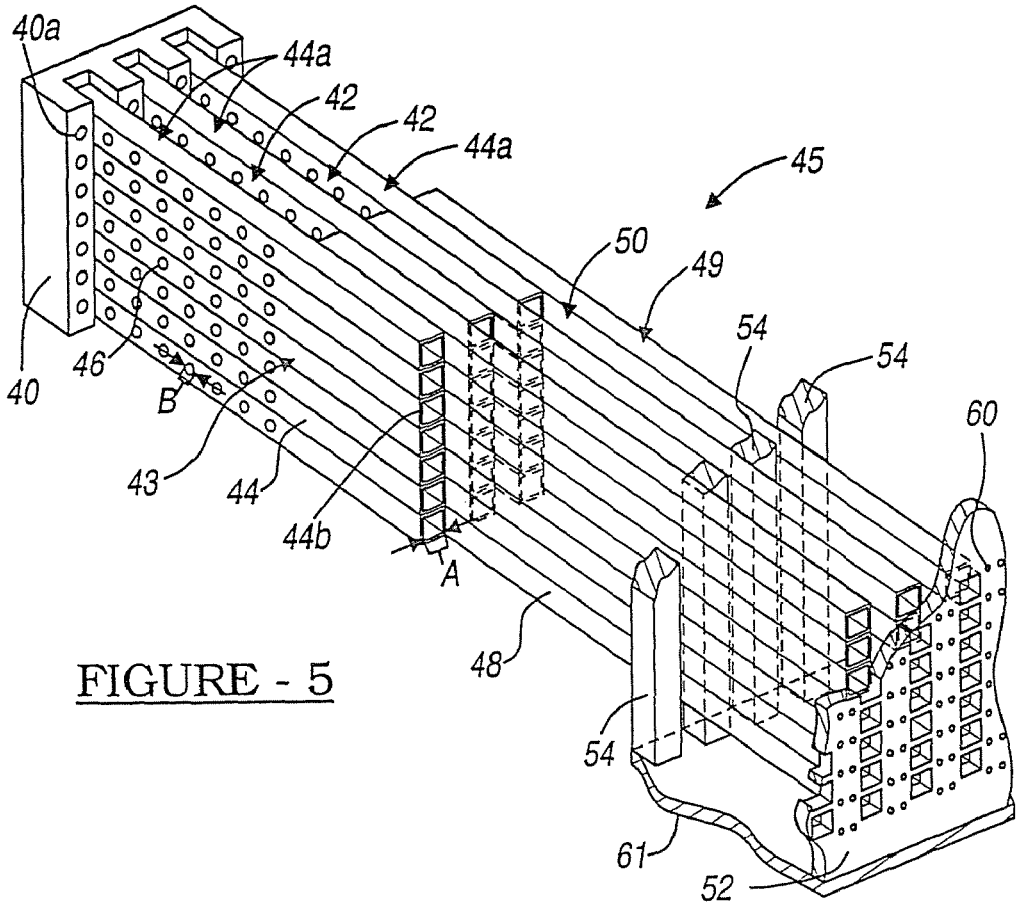
FIG. 5 is a detailed, partial cross-sectional, perspective view of a portion of the heat exchanger according to a second embodiment.

With continuing reference to FIGS. 1-3 and further reference to FIG. 4, a method of using the combustion chamber 14 according to various embodiments will be described. The combustor 14 includes a pre-mixer 42 which may be formed in any appropriate manner. The pre-mixer 42 may include an open region, as illustrated in FIG. 4, or may include a plurality of the cooling tubes 44, as illustrated in FIG. 5, and described further herein. When an open region is used as the pre-mixer 42 the flow generally follows the path indicated by the arrows in FIG. 4. It will also be understood that a plurality of tubes, as described above, are present in the heat exchanger, but have been removed for clarity in the present description of the air flow. Atmospheric air is compressed in the compressor 12 and then introduced into the heat exchange chamber 33 at a high pressure. The air that enters the heat exchange chamber 33 is directed by the directing fins to the top and bottom of the heat exchange chamber 33 so that the air may flow through the channels 50. The air that enters the heat exchange chamber 33 may be at a temperature between about 37° C. and about 427° C. (about 100° F. and about 800° F.). Generally, however, the air enters the heat exchanger 45 at a temperature of about 204° C. to about 400° C. (about 400° F. to about 750° F.).

As the air travels in the channels 50, the air increases in temperature to become "hot" air. The hot air flows through the pathway formed by the cooling tubes 44 and into the premix area 30. The hot air also receives thermal energy while flowing through the cooling tubes 44. It will be understood that the cooling tubes 44 are adjacent a portion of the heat exchange tubes 48. The temperature of the hot air, as it enters the premix area 30, is between about 427° C. and about 538° C. (about 800° F. and about 1000° F.). The air in the premix area 30 makes a turn within the premix chamber 42. As the air turns inside the premix chamber 42, the premix injector 40 injects fuel into the air, entraining the fuel in the air. About 5% to about 60%, which may vary depending on the fuel used, power requirements, etc., of all the fuel used to power the gas powered turbine 10 is entrained in this manner in the premix chamber 42.

After the air enters the premix chamber 42, it then flows out through the pathway formed by the heat exchange tubes 48. In the heat exchange tubes 48, the fuel in the air combusts as it engages the catalyst which is disposed on the inside walls of the heat exchange tubes 48. The catalyst may be disposed within the heat exchange tube 48 in a plurality of ways such as coating by painting or dipping or by affixing seals to the internal walls. As the fuel combusts, the temperature of the air rises to between about 768° C. and 930° C. (between about 1400° F. and about 1700° F.). As the temperature of the air rises, it becomes highly energetic to form high energy air, further the high energy air exits the heat exchange tubes 48. The temperature the high energy air reaches in the heat exchange tubes 48 is at least the hypergolic or auto-ignition temperature of the fuel being used in the gas powered turbine 10. Therefore, the high energy air that exits the heat exchange tubes 48 is, and may also be referred to as, hypergolic or auto ignition air. The auto-ignition temperature of the air is the temperature that the air may be at or above so that when more fuel is injected into the hypergolic air the fuel ignites automatically without any other catalyst or ignition source.

With reference to FIG. 5, a portion of the premix chamber 42, according to a second embodiment, is illustrated in greater detail. According to various embodiments, a plurality of the cooling tubes 44 are stacked vertically to form a cooling tube column 44*a*. Although, it will be understood, the cooling tubes 44 may be oriented in any appropriate way such as horizontally or angled. Each cooling tube 44 and the plurality of cooling tube columns 44*a* define a cooling pathway. Therefore, air can enter the combustion chamber 14, travel through the channels 50, adjacent the heat exchange tubes 48, and through the cooling pathway defined by each of the cooling tubes 44. The cooling tubes 44 include an inlet 44*b*. The inlet 44*b* is where the air enters the cooling tube 44 from the heat exchange channel 50. The cooling tube inlet 44*b* defines an inlet area A through which air may travel. The cooling tube inlet 44*b* is what allows the air to enter the cooling tube 44 as it travels to the premix chamber 42. In the premixer 42, each of the cooling tubes 44 defines a plurality of exit orifices or ports 46. Each of the exit orifices 46 include an exit area B. The air traveling through the cooling tubes 44 can exit the exit orifices 46 to enter the premix areas 42. Each exit orifice area B is generally smaller than the inlet area A, however, the total area of all of the exit orifice areas B may be equal to or greater than the inlet area A. Moreover, each of the cooling tubes 44 preferably includes a plurality of the exit orifices 46. Therefore, the total exit orifice area B for each cooling tube 44 is greater than the inlet area A. The specific ratio will depend upon the operating conditions, such as temperature or fuel type, for the combustor 14.

Figure 5A:
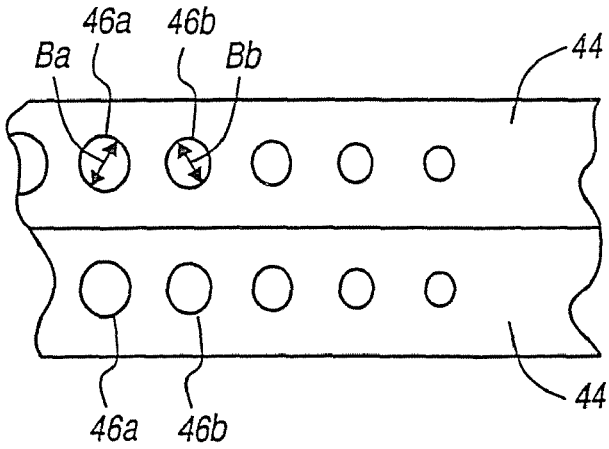
FIG. 5A is a detailed view of a portion of the pre-mixer according to the second embodiment.
Figure 5B:
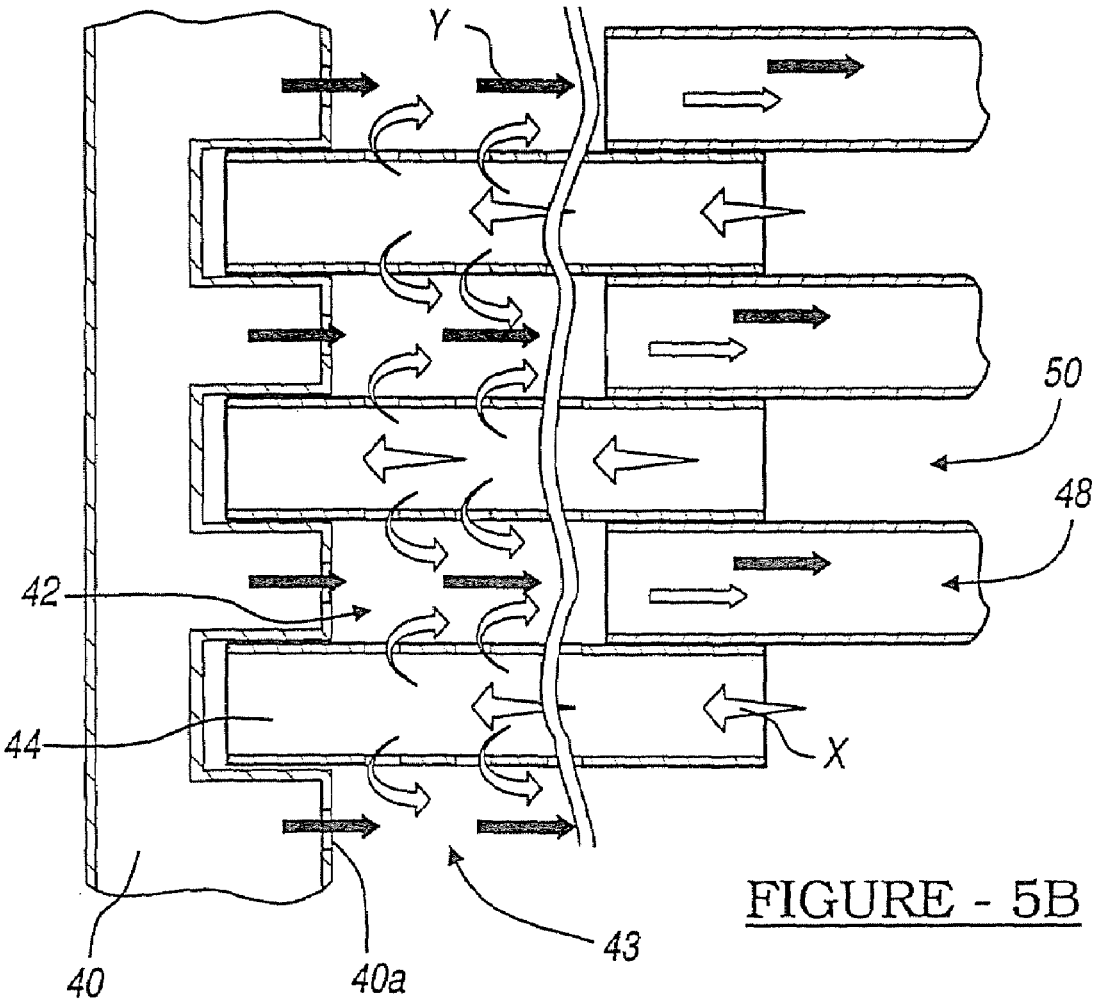
FIG. 5B is a simplified diagrammatic view of a theoretical airflow in the combustor according to the second embodiment.

With continuing reference to FIG. 5 and further reference to FIG. 5A, each of the exit orifices 46 may have a different exit diameter B. Therefore, a first exit orifice 46*a* may have a first exit orifice area Ba while a second exit orifice 46*b* has a second orifice area Bb. The exit orifice areas B may be altered to alter the equivalence ratio of the air to the fuel and may also be used to directly control the flow of the oxidizer from the cooling tubes 44 out of the exit orifices 46.

The premix injector 40 includes a plurality of premix fuel injectors 40*a*. Once the air exits the exit orifices 46 into the premix chamber 42, fuel is injected through the premix injector ports 40*a* to mix with the air that exits the cooling tubes 44. The number of premix injector ports 40*a* will depend upon the particular application and the fuel chosen to be combusted. After the air enters the premix chamber 42, it then flows out of the premix chamber 42 through the pathway formed by the heat exchange tubes 48.

Figure 6:
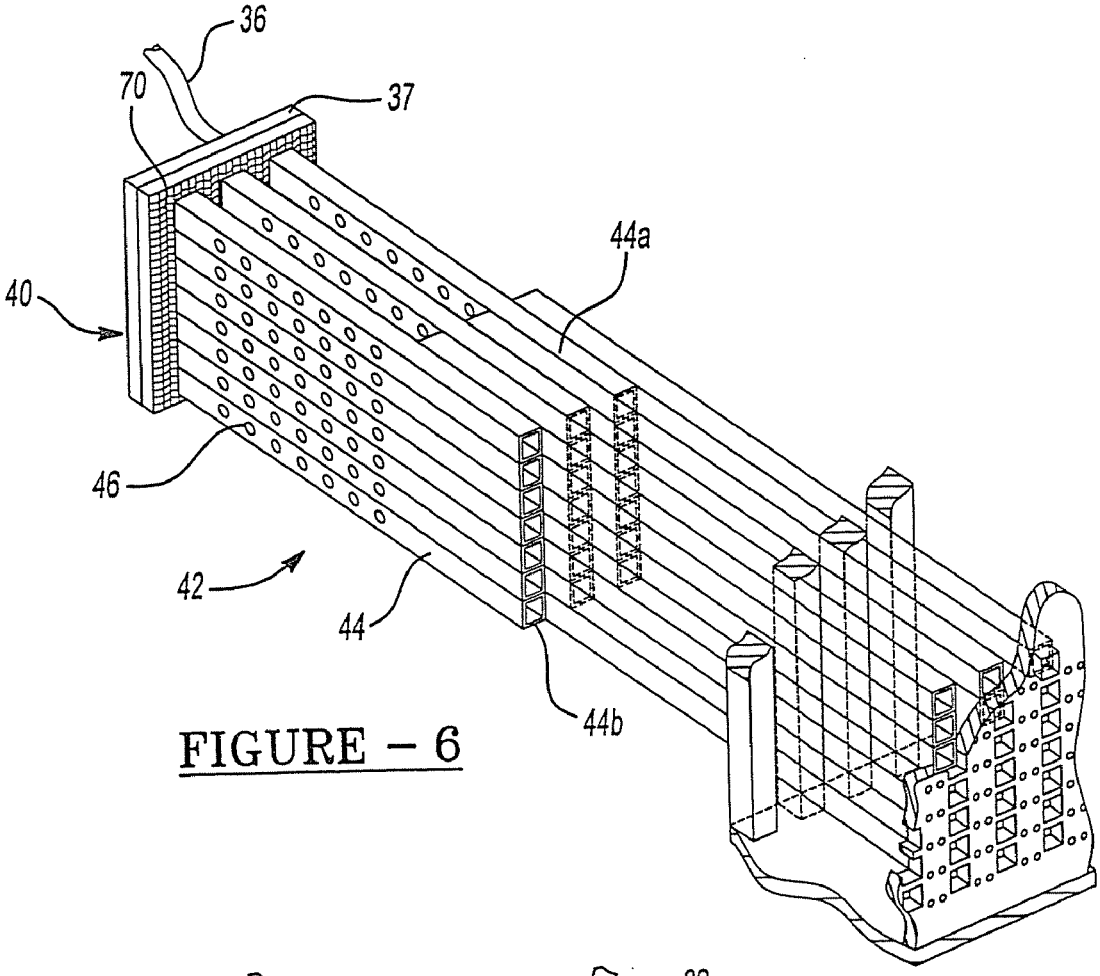
FIG. 6 is a detailed, partial cross-sectional, perspective view of a portion of the heat exchanger and premixer according to various embodiments.

With reference to FIG. 6, various alternative embodiments of the premix chamber 42 are illustrated. As discussed in relation to various embodiments, such as the premix chamber 42 illustrated in FIG. 5, each of the cooling tubes 44 may be part of a cooling tube stack 44*a*. The cooling tubes 44 may include a plurality of exit ports or exit orifice 46 that allow an oxidizer to exit the cooling tubes 44 to mix in the premixing chamber 42. The inlet 44*b* allows the oxidizer to enter the cooling tubes 44 and to be expelled out the exit ports 46 to mix with a selected portion of fuel injected from the premixer injector 40.

The premixer injector 40 may include a porous plate 70 from which a fuel may be expelled. Generally, the premix fuel line 36 provides a portion of fuel to the premix fuel manifold 37 and to the injector plate 40 such that the fuel may be expelled out pores defined by the porous plate 70. As discussed above, the fuel may be injected from the injector plate 40 to mix with an oxidizer that exits from the exit port 46 in a substantially even manner.

As discussed herein, the porous plate 70 may include a selected porosity, pore size, and other selected characteristics. Therefore, the porous plate 70 may define a substantially continuous and even porosity so that fuel may be injected into the premix area 42 in a substantially even and controlled manner or with substantially uniform flux. Therefore, rather than providing a plurality of injector ports, as discussed above, the porous plate 70 may act as defining a plurality of injector ports such that fuel may be injected into the premix area 42 in a selected manner.

Generally, the oxidizer tubes 44 abut the porous plates 70. Each of the tubes 44 may terminate in a closed end such that the oxidizer flowing through the tubes 44 does not get pushed through the porous plates 70. Rather, the closed ends of the tube 44, opposite the inlet 44*b*, allows the oxidizer to flow out the outlets 46 into the premix area 42 to be mixed with the fuel that is injected through the porous plates 70. Also, the tubes 44 generally define a fuel mixing area into which the oxidizer is expelled.

Figure 7:
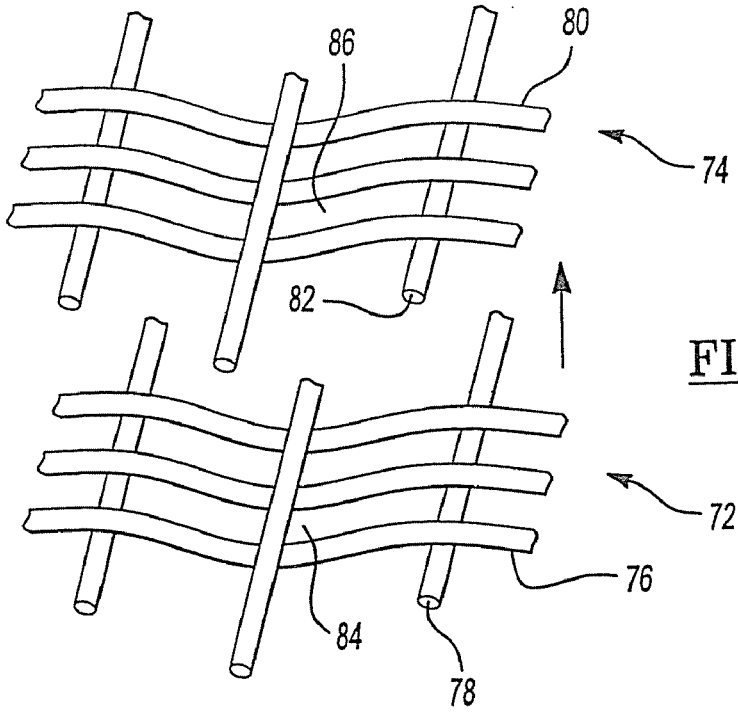
FIG. 7 is an exploded view of the porous injector plate according to various embodiments.

With reference to FIG. 7, the porous injector plate 70 may be formed by overlaying a first screen 72 with a second screen 74. The first screen 72 may include a plurality of horizontal fibers 76 interwoven with a plurality of vertical fibers 78. It will be understood that the terms horizontal and vertical are merely for reference and any appropriate direction may be used. In addition, the various fibers need not intersect each other at substantially right angles, but may be woven in any appropriate manner. Nevertheless, the second layer 74 also includes a plurality of horizontal fibers 80 and vertical fibers 82. The second fiber layer 74 is generally overlayered on the first fiber layer 72. Although only two layers are illustrated any appropriate number of layers may be used. For example, 14 layers of the fibers layers may be positioned on top of each other for a processing to form the porous plate 70. As discussed herein, the number of layers may be used to achieve a selected porosity or pore size.

Generally with the layers 72, 74 may define a selected pore 84 in the first layer 72 and a second pore 86 in the second layer 64. Generally the first pore 84 and the second pore 86 may be substantially the same, although they may be different. Again, the size of the pore 84, 86 may be chosen to create a selected porosity or selected pore size in the final porous plate 70.

In addition, the second layer 74 need not be oriented in a substantially similar manner as the first layer 72. For example, the second layer 74 may be rotated a selected degree or angle relative to the first layer 72. Therefore, it will be understood that the second layer 74 may be positioned over the first layer 72 in any appropriate manner.

The layers 72, 74 may also be formed of any appropriate material. For example, the fibers 76, 78, 80, 82 may be formed of a stainless steel. In addition, the various fibers may be formed of different materials such that a selected characteristic is formed in each of the fiber layers 72, 74 and the final porous plate 70. Regardless, the various layers 72, 74 are generally fixed together through a selected manner. For example, the first layer 72 may be sintered with the second layer 74 to achieve the selected porous plate 70. For example, if the layers 72, 74 are sintered, the process generally allows a cohesion of the various molecular bonds or molecules of the different layers and different fibers to substantially interconnect each of the layers 72, 74 to form the selected plate. Again, if the material is sintered and a selected number of layers are sintered together, a selected porosity and pore size may be achieved in the porous plate 70.

The number of layers of the materials 72, 74 may be selected to achieve the various selected characteristics. In addition, the number of layers, the size of the pores in the various layers, the materials of the various layers, and other specifics of the layers may be altered or varied to achieve other selected characteristics. Generally, these characteristics may be at least partially known before forming the porous plate 70 such that the porous plate 70 may be programmed or selected and simply be produced according to the pre-selected characteristics.

As discussed above, briefly, various different layers of material, materials, rough pore sizes in the layers of material, and other appropriate characteristic may be selected to achieve a desired porosity, pore size, stiffness, and other appropriate characteristics. It will be understood, however, that other techniques such as bonding, welding, abrazing, may be used to connect a plurality of layers of material to achieve a selected porosity and pore size. In addition, a selected material may be made porous through selected techniques such as puncturing or drilling holes in the material. Therefore, a specific type of porous material is not particularly necessary such that a selected porosity is achieved in the porous plate 70.

The porous plate 70 may include a selected porosity to achieve a selected maximum flux of fuel into the premixer 42. The flux from the porous plate 70 may, however, not be substantially uniform across the entire face of the porous plate 70. For example, it may be selected to provide more fuel to a selected area than a different area. Therefore, the flux of fuel across the face plate may be uniform or non-uniform. As an example, and not intended to be a limiting example, if natural gas is being used, the flux across the face plate may be about one pound per inch squared per second. It will be understood that this is merely exemplary of the flux achievable and any appropriate flux may be achieved across the face plate.

The flux of fuel may be substantially uniform because the porous plate 70 is substantially porous across its entire face and fuel is able to move from the premix manifold 37 to an upstream side of the porous plate 70 in a substantially uniform manner. Rather than providing a discrete number of injectors, as in the injector plate 40, the porous plate 70 provides a plurality of pores through which the fuel may be injected. It will be understood that the porosity of the porous plate 70 may also be selected depending upon the type of fuel chosen to be injected into the premixing area 42. For example, various fuels may include hydrocarbons, gases, liquids, hydrogen, and SYNTHESIS. The size of the pores may not be exact compared to each other and may include a range. Therefore, each pore in the injector plate 70 may be unique in size, but may be in the range. Also, the pore may be round, square, rectangle, or any appropriate shape and include the selected size. In addition, the porosity may also be chosen depending upon selected characteristics, such as an equivalence ratio in the premix area 42, the type of fuel to be injected into the premix area 42, and other selected characteristics. Again, the porosity may not be exactly uniform, and the porosity may be an average. The pore size and the pore density may be any appropriate pore size or pore density, depending upon selected properties. For example, a selected flux may require a selected pore size that is different from a separate flux. In addition, different fuels and power levels for the power plant, as an application, may require different fluxes of the fuel across a porous plate 70. Therefore, the pore size and pore density may differ depending upon the particular application. In addition, the pore size may be substantially random and only the flow through the porous plate 70 is known, for example, when the porous plate 70 is formed by the sintering method.

Therefore, the porous plate 70 is able to provide the uniform or desired fuel flux into the premix area 42 to provide fuel to the oxider that is provided to the premix area 42 and may be combusted in the heat exchanger area 32. In addition, the porous plate 70 may isolate the premixer fuel inlet 36 from a back flow due to acoustic or other effects. The fuel provided through the premixer fuel inlet 36 is generally substantially pressurized such that a pressure drop of about 10% to about 100% is achieved across the porous plate 70. The pressure drop is substantial enough and the porous plate 70 provides a physical barrier to acoustic effects forcing the fuel oxidizer backwards through the porous plate 70 into the premix manifold 37 due to various effects. For example, the combustion chamber is upstream of the porous plate 70 and the acoustic effects produced in the main combustor 34 may force material backwards through the porous plate 70 towards the premix manifold 37, thus the porous plate 70 also provides a barrier thereto, in addition to the pressure drop across the porous plate 70.

Positioned in the pre-mixer 42, according to various embodiments is a flash back inhibitor or suppressor. Specifically, a flash back suppressor is provided to limit or eliminate combustion of the fuel in the pre-mixer 42 before the fuel reaches the catalyst tubes 48. Appropriate combustion suppressors includes coatings to eliminate pre-oxyl radicals from forming or a physical structure that is at least the quenching distance for the fuel being injected into the pre-mixer 42. Other appropriate methods may also be used to inhibit combustion and/or flash back of the fuel before it reaches the catalyst tubes 48.

Additional fuel is injected through the main injector 52 as the air exits the heat exchange tubes 48 and enters the main combustion section 34. The fuel injected from the main injector 52 is injected through the individual injector ports 60. The injector port 60 may be any appropriate injector ports, such as those disclosed in U.S. Patent Publication No. 2003/0192319, published Oct. 16, 2003, entitled "Catalytic Combuster and Method for Substantially Eliminating Nitrous Oxide Emissions"; and U.S. Patent Publication No. 2005/0076648, entitled "Method and Apparatus for Injecting a Fuel Into a Combuster Assembly"; both of which are incorporated herein by reference. Any ratio of injector ports 60 to heat exchange tubes 48 may be used as long as all of the air exiting the heat exchanger 45 is thoroughly mixed with fuel. Any additional fuel to power the gas powered turbine 10 is injected at this point, such that fuel is added to the air at the premix chamber 42 and from the injector ports 60.

As the air travels through the heat exchange tubes 48, the fuel that was entrained in the air in the premix chamber 42 is combusted by the catalyst. This raises the temperature of the air from the temperature that it enters the heat exchange chamber 33. In particular, the temperature of the air is raised to generally between about 700° C. and 880° C. (between about 1300° F. and about 1600° F.). This temperature is generally the hypergolic temperature so that the fuel combusts spontaneously when added through the injector port 60. It will be understood that different fuels have different hypergolic temperatures. Therefore, the amount of fuel added in the premix section 42 may be altered to determine the temperature of the air exiting the heat exchange tubes 48.

As discussed above, the air that exits the heat exchanger 45 is at the auto-ignition or hypergolic temperature of the fuel used in the gas powered turbine 10. Therefore, as soon as the fuel reaches the temperature of the air, the fuel ignites. Since the fuel is thoroughly mixed with the air, the combustion of the fuel is nearly instantaneous and will not produce any localized or discrete hot spots. Because the fuel is so well mixed with the air exiting the heat exchanger 45, there is no one point or area which has more fuel than any other point, which could also create hot spots in the main combustion section 34. Therefore, the temperature of the air coming from the main injector 52 and into the main combustion section 34 is substantially uniform. During operation of the gas powered turbine 10, the fuel's characteristic mixing rate is shorter than the combustion rate of the fuel.

The temperature of the air, after the additional fuel has been combusted from the main injector 52, is between about 1315° C. and 1595° C. (about 2400° F. and about 2800° F.). Preferably, the temperature, however, is not more than about 1426° C. (about 2600° F.). Different fuel to air ratios may be used to control the temperature in the main combustion section 34. The main combustion section 34 directs the expanding gases into a transition tube (not shown) so that it engages the turbine fans 16 in the turbine area 15 at an appropriate cross sectional flow shape.

The use of the heat exchanger 45 raises the temperature of the air to create hot or heated air. The hot air allows the catalyst to combust the fuel that has been entrained in the air in the premix chamber 42 without the need for any other ignition sources. The catalyst only interacts with the hydrocarbon fuel and the oxygen in the air to combust the fuel without reacting or creating other chemical species. Therefore, the products of the combustion in the heat exchange tubes 48 are substantially only carbon dioxide and water due to the catalyst placed therein. No significant amounts of other chemical species are produced because of the use of the catalyst. Also, the use of the heat exchange tubes 48, with a catalyst disposed therein, allows the temperature of the air to reach the auto-ignition temperature of the fuel so that no additional ignition sources are necessary in the main combustion section 34. Therefore, the temperature of the air does not reach a temperature where extraneous species may be easily produced, such as NOX chemicals. Due to this, the emissions of the gas powered turbine 10 of the present invention has virtually no NOX emissions. That is, that the NOX emissions of the gas powered turbine 10 according to the present invention are generally below about one part per million volume dry gas.

Also, the use of the heat exchanger 45 eliminates the need for any other pre-burners to be used in the gas powered turbine 10. The heat exchanger 45 provides the thermal energy to the air so that the catalyst bed is at the proper temperature. Because of this, there are no other areas where extraneous or undesired chemical species may be produced. Additionally, the equivalence ratio of the premix area is generally low and about 10% to about 60% of the equivalence ratio of the main injector 52. This means that the fuel combustion may occur as a lean mixture in both areas. Therefore, there is never an excessive amount of fuel that is not combusted. Also, the lean mixture helps to lower temperatures of the air to more easily control side reactions. It will be understood that different fuel ratios may be used to produce different temperatures. This may be necessary for different fuels.

Figure 8:
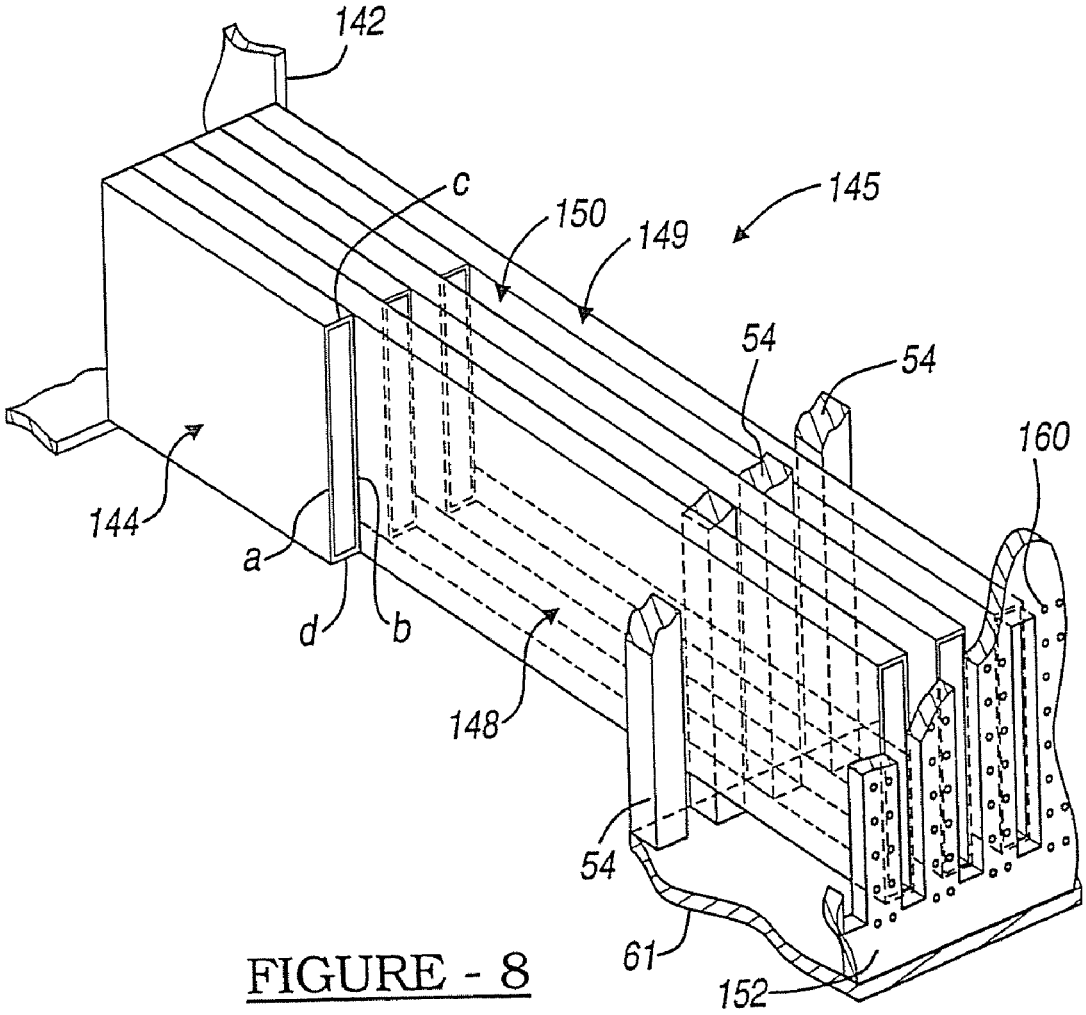
FIG. 8 is a detailed, partial cross-sectional, perspective view of a portion of the heat exchanger according to a second embodiment.

With reference to FIG. 8, a detail portion of the combustor 14, similar to the portion illustrated in FIG. 3, according to various embodiments of a heat exchanger 145 is illustrated. A premix chamber 142 allows air from the compressor to be mixed with a first portion of fuel. Air comes from the compressor and travels through a cooling fin 144 rather than through a plurality of cooling tubes 44, as discussed above in relation to the first embodiment. It will be understood that exit ports may also be formed in the cooling fins 144 to form the premix area 142. The cooling fin 144 is defined by two substantially parallel plates 144*a* and 144*b*. It will be understood, however, that other portions, such as a top and a bottom will be included to enclose the cooling fin 144. Additionally, a heat exchange or catalyst fin 148 is provided rather than heat exchange tubes 48, as discussed above in the first embodiment. Again, the catalyst fin 148 is defined by side, top, and bottom walls and defines a column 149. Each catalyst column 149, however, is defined by a single catalyst fin 148 rather than a plurality of catalyst tubes 48, as discussed above. The cooling fin 144 may include a plurality of cooling fins 144. Each cooling fin 144, in the plurality, defines a cooling pathway. Similarly, the heat exchange fin 148 may include a plurality of heat exchange 148 fins. Each, or the plurality of, the heat exchange fins 148 defines a heat exchange or catalyst pathway.

Channels 150 are still provided between each of the catalyst fins 148 so that air may flow from the compressor through the cooling fins 144 into the premix chamber 142. Air is then premixed with a first portion of fuel and flows back through the catalyst fins 148 to the main injector plate 152. Injection ports 160 are provided on the main injector plate 152 to inject fuel as the air exits the catalyst fin 148. A suitable number of injection ports 160 are provided so that the appropriate amount of fuel is mixed with the air as it exits the catalyst fins 148. An intra-propellant plate 54 is also provided.

Injector ports 60 are still provided on the main injector plate 152 to provide fuel streams (not illustrated) as heated air exits the oxidizer paths (not particularly shown) from the catalyst fins 148. Either of the previously described injector ports 60 or 90 may be used with the second embodiment of the heat exchanger 145 to provide a substantial mixing of the fuel with the air as it exits the catalyst fins 148. This still allows a substantial mixture of the fuel with the air as it exits the catalyst fins 148 before the fuel is able to reach its ignition temperature. Therefore, the temperatures across the face of the main injector 152 and in the combustion chamber 34 are still substantially constant without any hot spots where NOX chemicals might be produced.

It will also be understood that the cooling fins 144 may extend into the pre-mixer 142 similar to the cooling tubes 44. In additional ports may be formed in the portion of the cooling fins 144 extending into the pre-mixer to all the air to exit the cooling fins and mix with a first portion of fuel. Therefore, the combustor according to the second embodiment may include a pre-mixer 142 substantially similar to the pre-mixer illustrated in FIG. 5, save that the ports are formed in the cooling fins 144 rather than individual cooling tubes 44. In addition, this alternative embodiment may include a combustion inhibitor to assist in eliminating combustion in the pre-mixer 142.

It will be further understood that the heat exchanger, according to the present invention, does not require the use of individually enclosed regions or modular portions. Rather the heat exchanger may be formed of a plurality sheets, such as corrugated sheets. A first set of these sheets are oriented relative to one another to form a plurality of columns. The first set of sheets includes a catalyst coated on a side facing an associated sheet, such that the interior of the column includes the catalyst to contact the airflow. In this way, the catalyst need not be coated on the interior of a closed space, but rather the space is formed after the catalyst is coated to form the catalyst pathway. Operatively associate with the first set of sheets is a second set of sheets, defining a second set of columns disposed at least partially between the first set of columns. Thus, in a manner similar the heat exchanger 145, heat exchange columns and cooling columns are formed. These then form the catalyst pathway and the cooling pathway in operation of the combustor.

The present invention thus provides an apparatus and method that virtually or entirely eliminates the creation of NOX emissions. Advantageously, this is accomplished without significantly complicating the construction of the gas powered turbine 10 or the combustors 14. Although the present invention, such as claimed in the appended claims, may be used to produce a combustor system that is able to substantially eliminate or reduce selected emissions, such as nitrous oxide emissions, it will be understood that the present invention may be applied to any appropriate application. Therefore, the invention may be applied to a system which is not necessarily used to reduce selected compounds, although it may be.

The description of the invention is merely exemplary in nature and, thus, variations that do not depart from the gist of the invention are intended to be within the scope of the invention. Such variations are not to be regarded as a departure from the spirit and scope of the invention.

What is claimed:

1. A system for allowing a substantially even flux of a fuel into a combustor for a power plant, comprising:

a premix chamber;

a porous injection plate adjacent the premix chamber;

a preheat chamber adjacent the premix chamber;

first tubes that extend between the preheat chamber and the premix chamber, the first tubes each including an open end in the preheat chamber and a plurality of orifices that outlet in the premix chamber; and second tubes that include open ends in the premix chamber and extend through the preheat chamber to a fuel injector plate.

2. The system of claim 1, wherein the second tubes include interior walls that are coated with a catalyst.

3. The system of claim 1, wherein the first tubes and the second tubes extend parallel to each other.

4. The system of claim 1, wherein the first tubes and the second tubes extend are brazed together.

5. The system of claim 1, wherein the second tubes are stacked to form a plurality of columns, and the columns are laterally spaced to form open channels between the columns.

6. The system of claim 1, wherein, for each first tube, a combined area of the orifices is greater than a cross-sectional area of the open end.

7. The system of claim 1, wherein a first one of the orifices has a different area than a second one of the orifices.

8. The system of claim 1, wherein the second tubes extend through a fuel manifold to the fuel injector plate, the fuel injector plate including injector orifices that fluidly connect the fuel manifold on one side with a combustion section on the other side of the fuel injector plate, and there is a ratio of the number of second tubes to the number of injector orifices that is at least 1.

9. The system of claim 1, wherein the porous injection plate includes a first layer of unidirectionally-oriented fibers and a second, adjacent layer of unidirectionally-oriented fibers that do not intersect the fibers of the first layer.

* * * * *